US006282813B1

(12) United States Patent
Squadroni

(10) Patent No.: US 6,282,813 B1
(45) Date of Patent: Sep. 4, 2001

(54) SHOE SOLE PROVIDED WITH TRANSPIRATION AID AVOIDING THE INLET OF LIQUIDS FROM THE OUTSIDE

(76) Inventor: Onifares Elpidio Squadroni, Via Vela 99-62012, Civitanova Marche (MC) (IT)

( * ) Notice: Subject to any disclaimer, the term of this patent is extended or adjusted under 35 U.S.C. 154(b) by 0 days.

(21) Appl. No.: 09/402,161

(22) PCT Filed: Apr. 17, 1998

(86) PCT No.: PCT/IT98/00090

§ 371 Date: Dec. 10, 1999

§ 102(e) Date: Dec. 10, 1999

(87) PCT Pub. No.: WO98/47399

PCT Pub. Date: Oct. 29, 1998

(30) Foreign Application Priority Data

Apr. 18, 1997 (IT) ..... RM97A0226

(51) Int. Cl.[7] ..... A43B 7/08
(52) U.S. Cl. ..... 36/3 B
(58) Field of Search ..... 36/3 B, 3 R

(56) References Cited

U.S. PATENT DOCUMENTS 2,090,881 * 8/1937 Wilson .
3,061,950 11/1962 Levine .
4,063,371 * 12/1977 Batra .
4,118,878 * 10/1978 Semon .
4,290,211 9/1981 Csengeri .
4,345,387 * 8/1982 Daswick .
5,588,226 12/1996 Schenkel .
5,746,012 * 5/1998 Caletti et al. .
5,992,052 * 11/1999 Moretti .

FOREIGN PATENT DOCUMENTS 0103061 3/1984 (EP) .
0382904 8/1990 (EP) .
2495447 6/1982 (FR) .
2290016 12/1995 (GB) .

* cited by examiner

*Primary Examiner*—Ted Kavanaugh
(74) *Attorney, Agent, or Firm*—Stevens, Davis, Miller & Mosher, LLP

(57) ABSTRACT

A shoe comprising a sole with a plurality of check valves provided for discharging air from the inside of the shoe. The check valve having a microhole and a concave zone wherein the air is forced out the bottom of the shoe sole through the valves upon pressure exerted by the wearer.

24 Claims, 4 Drawing Sheets

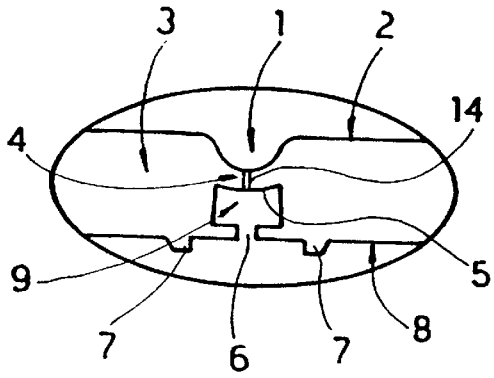
FIG. 2
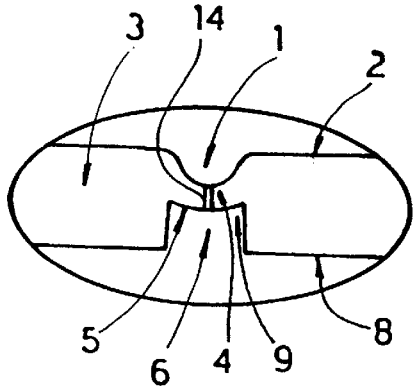
FIG. 3
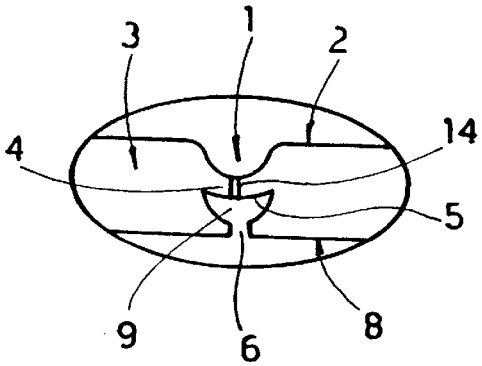
FIG. 4
FIG. 7
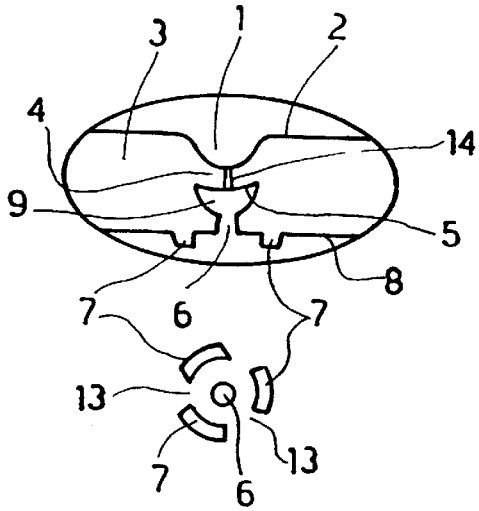
FIG. 8

SHOE SOLE PROVIDED WITH TRANSPIRATION AID AVOIDING THE INLET OF LIQUIDS FROM THE OUTSIDE

This application is a 371 of PCT/IT98/00090 filed on Apr. 17, 1998.

FIELD OF THE INVENTION

The present invention relates to a sole for any type of shoes, particularly a sole made, for example, of moulded rubber, characterized in that its construction is such as to guarantee an effective transpiration of the foot and to be impermeable to water and humidity.

BACKGROUND OF THE INVENTION

Especially in case of shoes provided with a rubber sole it is extremely important to ensure an effective ventilation of the foot in order to avoid that an excessive perspiration causes the sweat to impregnate the fixed insole in contact with the skin of the foot and to produce annoying damages such as reddening of the skin, sores, etc., besides bad smell.

On the other hand many shoes with leather sole are not devoid of such a trouble.

In order to overcome such a problem a number of solutions have been brought forward, among which a recent one has been described in Italian Patent No. 1,232,798, available on the market with the name GEOX (registered trademark). Such a solution provides an osmotic membrane placed in the rubber sole and communicating with the inside of the shoe through holes in the fixed insole and with the outside through holes in the tread. As a result, the sole is made to transpire, though it stays impermeable to humidity. Although the membrane is protected by suitable layers of inert, transpiring material and it stands the mechanical stress due to the extension and torsions caused by the movement during walking, such a solution does not provide suitable guarantees of durability for the shoe as it requires strict maintenance conditions which cannot be easily kept up. One example is that the shoe must not be dried by heat sources so as not to damage the membrane.

SUMMARY OF THE INVENTION

The present invention seeks to provide a solution to the problem of transpiration, for example, of a rubber sole or a leather sole, keeping the impermeability unchanged without using membranes made of special material and as such needing particular care, but only providing within the width of the sole a plurality of air discharging valves of resilient material provided with microholes establishing a communication between the inside and the outside of the shoe and acting as check valves. Advantageously, in case of rubber soles, such valves are preferably one piece and made in one moulding step along with the sole, and essentially consist of a membrane provided with a cavity directed towards the fixed sole on its upper side and with a hollow space or a chamber which communicates with the tread and then with the outside on its lower side. Such a chamber is capable of protecting the membrane from any type of atmospheric agent.

The microhole of each valve is made in the membrane at the centre of its concavity.

According to another feature of the invention, the microhole is pierced through the membrane during a machining step following the moulding of the sole which is processed again to mechanically pierce the membrane by needles or stings. It should be appreciated that in such a way the hole pierced through the membrane will never result to be fully regular as it would be the case if the hole was pierced during the moulding step, but it looks much like a tearing so that the membrane can perfectly plug into it.

Such a combination of measures during walking causes the user's weight to increase the air pressure in the chambers so as to oppose to the concavity of the membrane, following the deflection and the resilient deformation of the chambers located in the area in contact with the ground. Thus the hole inside the membrane closes and prevents outside fluids from entering the shoe. On the other hand, when the pressure inside the membrane is greater than the pressure in the outer chamber, the hole inside the concave membrane is opened causing the release of the inner air until the inside pressure coincides with the outside pressure.

Number and distribution of the valves in the sole may obviously be different according to the circumstances. Sometimes only a few valves located in suitable zones of the tread, for example near the heel or in three zones of the foot sole corresponding to toes, arch, and heel, etc. may be provided.

As an alternative, rather than having the valves of resilient material made in one piece with the sole during one moulding step, they may be inserted through holes made at crucial spots of the sole.

Further advantages and features of the invention will be more readily apparent from the following detailed description with reference to the accompanying drawings which show only by way of a not limiting example some preferred embodiments. In the drawings:

BRIEF DESCRIPTION OF THE DRAWINGS

FIGS. 2 to 4 show a sectioned view of some embodiments of the discharge valve;

FIGS. 7 and 8 show a section view and a plan view, respectively, of an embodiment of the invention which provides studs all around the valve;

DETAILED DESCRIPTION OF THE PREFERRED EMBODIMENTS

Figure 1:
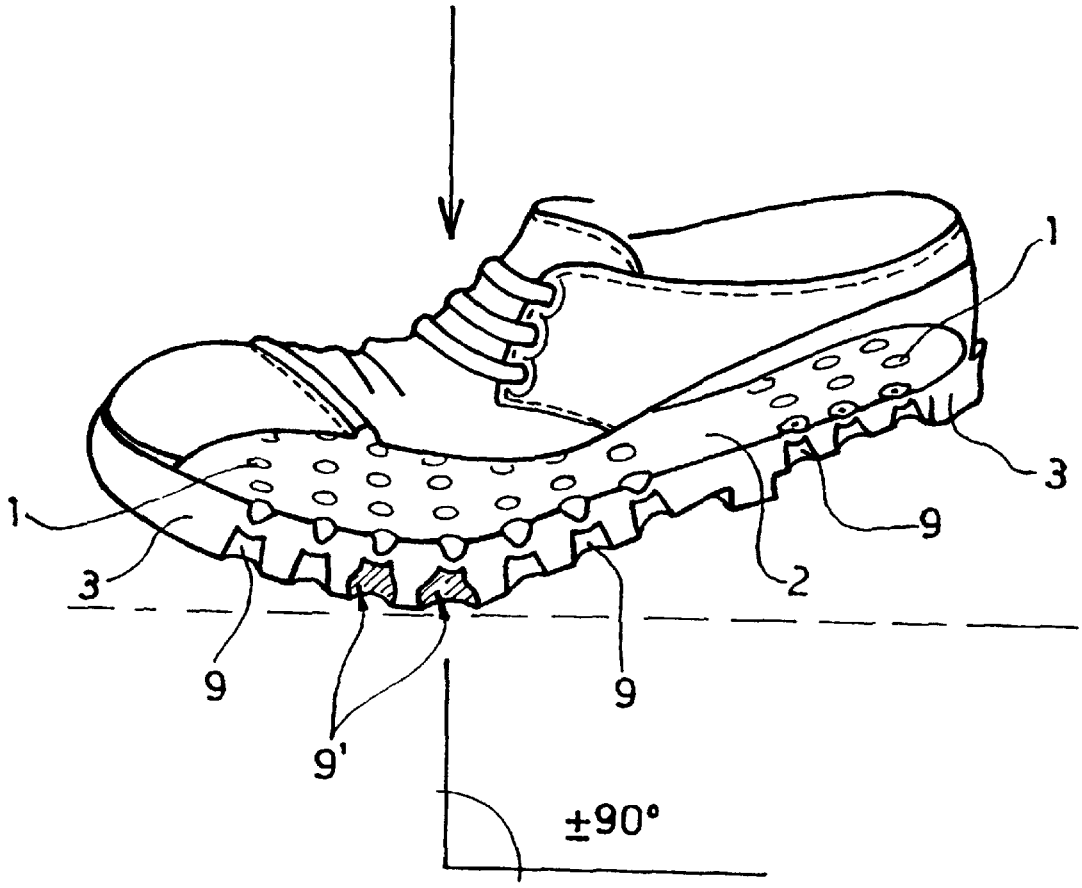
FIG. 1 shows a perspective view of a shoe during walking with a sole provided with discharge valves according to the present invention, from which the perforated fixed insole has been fully removed and the left side of the vamp has been partially removed in order to show the way the valves are arranged on the upper portion of the sole.

With reference to the figures, the functioning of the check valve for the discharge of inside air can be referred to that of ordinary rubber or latex valves, for example, used in catheter and comprising a membrane with reduced thickness provided with an upward pointing concavity which closes a tubular conduit connected to an inflatable bladder. After piercing the membrane and blowing air therein, the bladder will inflate and remain swollen as the pressure acting on the membrane itself will close the microhole through which air had passed just thanks to the concavity of the membrane.

Turning now to FIG. 2, it is shown therein a partial section of a sole 2 (preferably made of rubber or leather, most preferably rubber) provided with a discharge valve according to a first embodiment of the invention. As it can be seen, the valve encircled by an oval frame for a better illustration is made during one moulding step in one piece with sole 2 (though it can instead be later inserted into moulded sole 2) and essentially includes a membrane 4 with reduced thickness which limits a concave zone 1 at the upper side. Such a zone has preferably, but not necessarily, a circular plan. Even the lower surface of the membrane, indicated at 5, is slightly curved with the concavity directed upwards. Such a surface is the ceiling of a hollow space, cell or chamber 9 which communicates with road surface 8 through orifice 6.

Such orifice can be more or less wide (compare the reduced dimension of the orifice of FIG. 2 with that of the orifice of FIG. 3, where chamber 9 is fully open towards tread 8).

Figure 5:
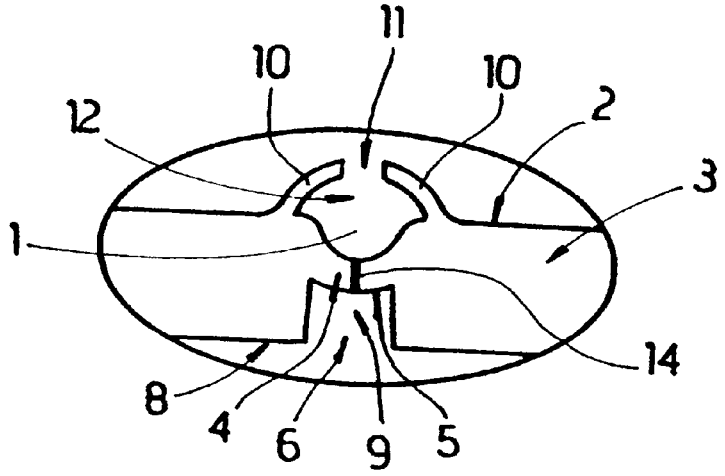
FIGS. 5 an 6 show another embodiment which provides a perforated igloo-shaped dome above the discharge valve.
Figure 6:
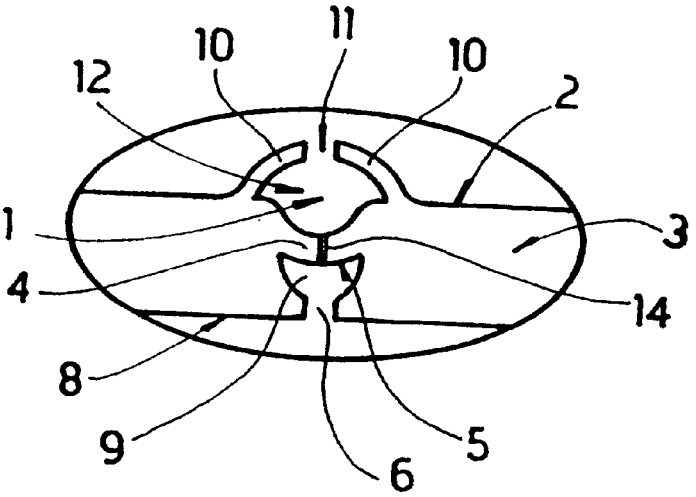

According to the present invention a through microhole 14 is pierced inside membrane 4. Such a microhole is preferably pierced at its centre and has such a dimension as to be only open when the pressure on the tread side is lower than the inside pressure. The operation is schematically illustrated in FIG. 1. During walking, as with an increase in the user's weight the concavity of the membrane concurrently increases opening the holes, in contrast to that there does occur a pressure increase inside chambers 9' over the area of maximum contact with the ground, which will cause membrane 4 to be compressed from below and consequently the holes of all of the corresponding valves to be closed. As it can be seen from the figure, chambers 9 of the other valves not lying along the vertical weight pressure vector are decompressed, thus causing the air inside the shoe to easily escape. FIGS. 3 to 6 show a number of valves different from one another in terms of the shape of chamber 9 (FIGS. 2, 3, 4) and/or for the presence of a curved lip 10 projecting along the periphery of upper concavity 1 (FIGS. 5 and 6). Such lip defines a dome-shaped chamber 12 or an igloo which communicates with the outside through a central hole 11 at its top. Since such a dome or igloo 12 directly contacts the fixed insole during the dynamics of walking, it acts as a pump just thanks to its deformation and following resilient return that causes air inside the shoe to be forcibly expelled through the hole in the underlying membrane operating as a check valve during walking and with repeated, cycles of loading onto and unloading from the sole of the user's weight. In addition, such a dome or igloo exerts a real massaging action on the foot.

FIGS. 7 and 8 show another embodiment of the invention which provides studs 7 distributed all around hole 6 of chamber 9. Such studs have the function of breaking the liquid film on the road after a shower avoiding the aqua planing effects.

Figure 9:
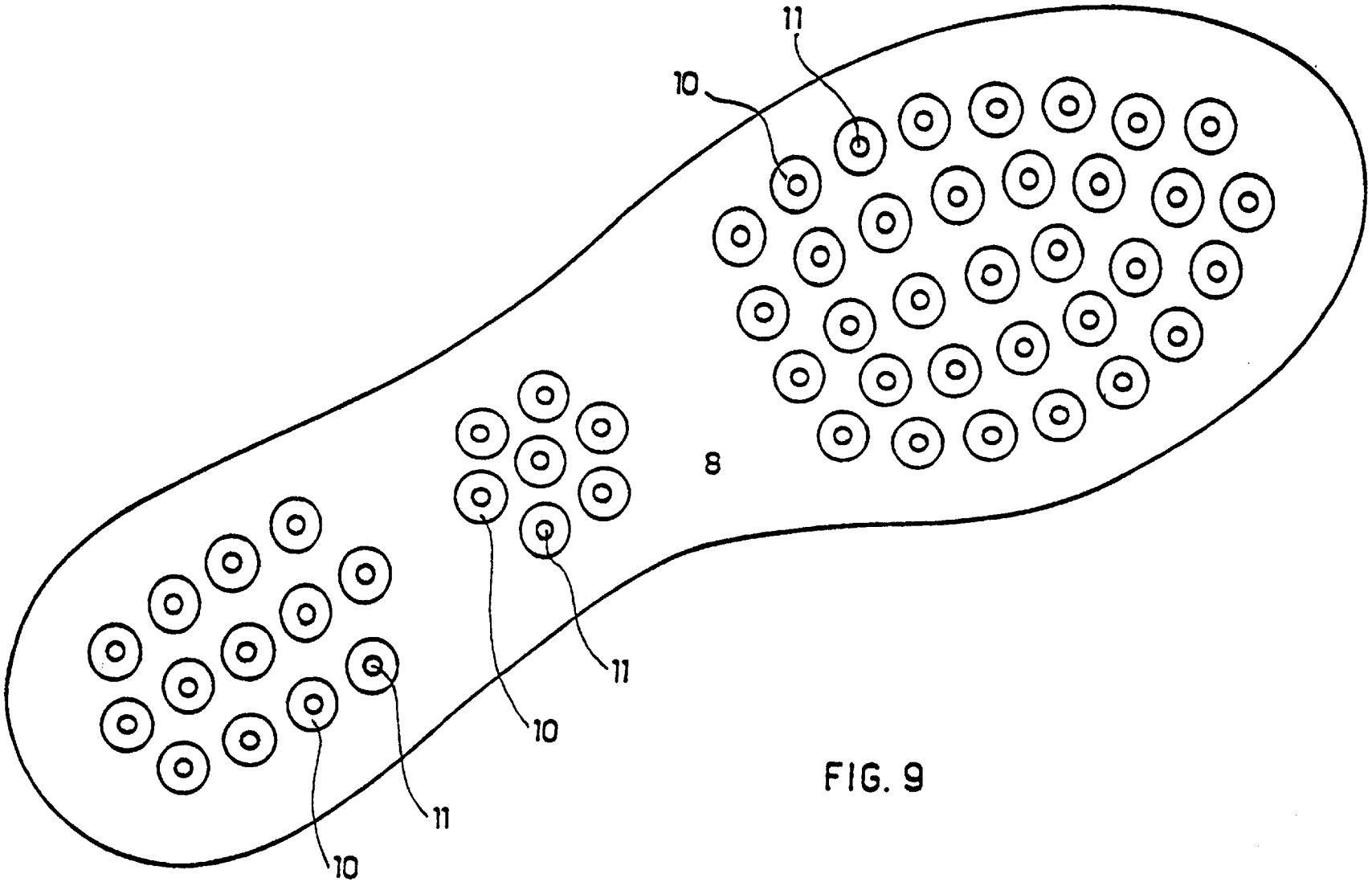
FIG. 9 is a plan view of the sole from the insole side and shows the way the valves are arranged according to the embodiment of FIGS. 5 and 6.

FIG. 9 shows a typical distribution of the valves in three significant areas of the sole. The illustrated embodiment is that of FIGS. 5 and 6 with a circular lip 10 and a central hole 11.

It is self-evident that the embodiment of FIGS. 5 and 6, i.e. that with igloos, the distribution of the igloos on the upper surface of the sole should be such as to ensure an even bearing of the fixed insole which should not be affected, of course, by the presence of uncomfortable relief on the ground. On the other hand, it is not necessary that a check valve corresponds to each igloo. Their number can be limited with regard to that of igloos so as to be only provided in the most suitable spots.

It is evident that as an alternative to the valves made in one piece and one moulding step along with the sole, as described so far, the use of valves inserted in the sole may be provided. Particularly such valves can be made with materials having a specific weight different from that of the sole so as to combine their resilient features with those of the sole in the best possible way in order to reach the desired objectives. It should be taken into consideration, for example, the case of a leather sole.

These and other changes which can be made by those skilled in the art are to be considered in the scope of the present invention as defined in the appended claims.

What is claimed is:

1. A shoe having therein a shoe sole in which there are provided a plurality of check valves for discharging air contained in an inside of the shoe said check valves being made of a resilient material and each provided with a microhole connecting the inside of the shoe with an outside, such valves being formed of a membrane provided with a concavity that has a concave surface directed towards a fixed insole inside said shoe and beneath which a hollow space or chamber is formed which communicates through a lower side of the membrane with the outside and a tread of the shoe.

2. The shoe sole of claim 1, wherein the microhole of each valve is pierced at the centre of its concavity.

3. The shoe sole of claim 1, wherein said concave membrane has a circular plan.

4. The shoe sole of claim 1, wherein said fixed insole is perforated and wherein even the lower side of the membrane is slightly curved with a concavity directed upwards at the perforated fixed insole, and wherein said lower side of the membrane forms a ceiling of the chamber.

5. The shoe sole of claim 1, wherein the membrane has a thickness which is essentially smaller that the thickness of the sole.

6. The shoe of claim 1, wherein, during walking, when a pressure in the chamber exceeds a pressure inside the membrane, the hole in the membrane closes and makes the shoe impermeable.

7. The shoe sole of claim 1, wherein the inside air escapes until the inside pressure is compensated by the pressure in the chamber.

8. The shoe sole of claim 1, made by a process comprising the step of moulding the check valves and sole in one piece in one moulding step.

9. The shoe sole of claim 1, wherein the microhole in the membrane of the valve is made by a process comprising the steps of moulding the sole and, after the moulding, mechanically piercing the membrane by means of needles or stings.

10. The shoe sole of claim 1, wherein said check valves are inserted into said sole.

11. The shoe sole of claim 10, wherein the membrane and the chamber in said inserted check valves are made in one piece inside the body of a tubular valve.

12. The shoe sole of claim 10, wherein said check valves are made of materials having a different specific weight than that of the sole.

13. The shoe sole of the claim 1, wherein the check valves of resilient material are inserted into a leather sole.

14. The shoe sole of claim 1, wherein the sole has one or more built-in parts of material with different specific weight in which the check valves of resilient material are inserted.

15. The shoe sole of claim 1, wherein the chambers have tapered walls so as to facilitate the expulsion of debris.

16. The shoe sole of claim 1, wherein there is provided a curved lip projecting along a periphery of the concavity of the membrane and forming an upper chamber shaped as a dome which communicates with the inside of the shoe through a central hole at its top.

17. The shoe sole of claim 16, wherein said central hole is aligned with the microhole in the concave membrane.

18. The shoe sole of claim 16, wherein said domes or igloos have the double function of massaging the foot and acting as pumps which cause the inner air to be forcibly expelled.

19. The shoe sole of claim 1, wherein spacing studs avoiding the aqua planing effects are provided on the tread all around the hole in the chamber.

20. The shoe sole of claim 1, wherein the valves are distributed over areas of the sole selected from the group consisting of the whole sole and those corresponding to toes, arch and heel.

21. The shoe sole of claim 1, wherein the check valves and sole comprise one piece formed from one mould.

22. A shoe having a shoe sole, said shoe sole separating an inside of said shoe from an outside of said shoe, wherein in said sole a plurality of circular check valves are provided for discharging air from the inside of the shoe, each of said check valves comprising a circular membrane having an upper central circular concavity, wherein a concave surface of the concavity faces upward towards the inside of the shoe, a lower central circular chamber, wherein a concave surface of the chamber faces downwards towards a tread of the shoe, a diaphragm or screen separating said upper concavity from said lower chamber, a pierced microhole in said diaphragm for connecting said upper concavity to said lower chamber, wherein said shoe further comprises an air permeable insole on top of said shoe sole, whereby a pressure exerted by a foot on the insole causes the air contained within the shoe to pass from said upper concavity to said lower chamber and to discharge to the outside of the shoe.

23. A shoe sole according to claim 22, in which said upper concavity is partially covered by a circular arcuated lip and has a central opening for the passage of air towards said lower chamber, whereby said lip exerts a double action of increasing the expulsion force of the air and exerting a massaging action on a user's foot.

24. The shoe sole according to claim 23, wherein said central opening is aligned with the microhole pierced in said diphragm.

* * * * *